US007081864B2

(12) United States Patent
Okamura et al.

(10) Patent No.: US 7,081,864 B2
(45) Date of Patent: Jul. 25, 2006

(54) ANTENNA COIL AND TRANSMISSION ANTENNA

(75) Inventors: Shinji Okamura, Tokyo (JP); Hozumi Ueda, Tokyo (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 10/493,406

(22) PCT Filed: Sep. 30, 2002

(86) PCT No.: PCT/JP02/10191

§ 371 (c)(1),
(2), (4) Date: Oct. 7, 2004

(87) PCT Pub. No.: WO03/036761

PCT Pub. Date: May 1, 2003

(65) Prior Publication Data

US 2005/0030251 A1 Feb. 10, 2005

(30) Foreign Application Priority Data

Oct. 22, 2001 (WO) ..... PCT/JP01/09251

(51) Int. Cl.
*H01Q 7/08* (2006.01)

(52) U.S. Cl. ..... 343/788

(58) Field of Classification Search ..... 343/787, 343/788, 741, 742, 866, 895
See application file for complete search history.

(56) References Cited

U.S. PATENT DOCUMENTS 5,521,609 A * 5/1996 Desch et al. ..... 343/788
6,163,305 A * 12/2000 Murakami et al. ..... 343/788
6,222,506 B1 * 4/2001 So ..... 343/895
6,529,169 B1 * 3/2003 Justice ..... 343/788

FOREIGN PATENT DOCUMENTS

| | | |
|---|---|---|
| JP | 50-102234 | 8/1975 |
| JP | 58-172208 | 11/1983 |
| JP | 59-022503 | 2/1984 |

OTHER PUBLICATIONS

Hasegawa, K., "Ferrite Antenna", Patent Abstracts of Japan, JP No. 59-152703, Aug. 31, 1984.
Takamiya, I. et al., "Contactless IC Card Communication Equipment", Patent Abstracts of Japan, JP No. 09-270742, Oct. 14, 1997.
Ieda, S. et al., "Loop Antenna Device", Patent Abstracts of Japan, JP No. 2001-257526, Sep. 9, 2001.

* cited by examiner

*Primary Examiner*—Tan Ho
(74) *Attorney, Agent, or Firm*—Finnegan, Henderson, Farabow, Garrett & Dunner, L.L.P.

(57) ABSTRACT

In a transmission antenna provided with an antenna coil outfitted with a core whereon a coil is mounted by winding, and with a capacitor connected to the aforementioned coil forming a serial resonance circuit between the aforementioned antenna coil inductance, the aforementioned antenna coil is outfitted with small core screw with a core smaller than the aforementioned core, and with a joining material that magnetically joins the aforementioned screw to the aforementioned core and with a screw hole that serves as a non-magnetic distance adjuster whereby the distance between the aforementioned core and the aforementioned screw is adjustable, and the resonance frequency is set by adjusting the thread volume of the aforementioned screw.

10 Claims, 8 Drawing Sheets

ANTENNA COIL AND TRANSMISSION ANTENNA

This application is a 371 of PCT/JP02/10191 filed on Sep. 30, 2002.

TECHNICAL FIELD

The present invention relates to a transmission antenna used in, for example, RFID (Radio Frequency Identification) and such at a LF (Low Frequency) band.

PRIOR ART

Conventionally, a transmission antenna is used for the aforementioned LF band RFID in door key locking and unlocking. In this case, a conventional transmission antenna is a resonance circuit structured so that an antenna coil is mounted by winding onto a ferrite core, and this antenna coil is connected to a capacitor. The capacitor capacity and the number of cycles in the analog coil are set so as to yield the desired resonance frequency.

With capacitors, though, it is hard to produce products accurately with the same static electricity capacity. Discrepancies arise is the static electricity capacities of manufactured capacitors. Discrepancies also arise in the inductances of analog coils. Thus there are times these discrepancies cause gaps in the resonance frequency, and the electromotive force that an antenna generates decreases. Consequently, there is concern about the communication distance shortening.

INVENTION DISCLOSURE

The present invention was created to correct the aforementioned conditions and its objective is to obtain a transmission antenna whose resonance is easily regulated. Another objective is to provide an antenna coil used in this sort of transmission antenna. The present invention also lies in obtaining a transmission antenna with adjustable resonance frequency without affecting the directivity of the antenna. Another objective is provide the antenna coil used in this sort of transmission antenna.

Firstly, the present invention provides an antenna coil outfitted with a core whereon a coil is mounted by winding and wherein a small hole is perforated, and a small core provided in a mobile fashion in the aforementioned small hole.

Secondly, the present invention provides a core whereon a coil is mounted by winding, a small core that is smaller than this core, and a joining material that magnetically joins the aforementioned core whereon a coil is mounted by winding to the aforementioned small core and having a non-magnetic distance adjuster to adjust the distance between the aforementioned core and the aforementioned small core.

Thirdly, the present invention provides an antenna coil whereby in a transmission antenna outfitted with an antenna coil having a core whereon a coil is mounted by winding and a capacitor connected to the aforementioned coil and forming a serial resonance circuit between the inductance of the aforementioned antenna coil, the aforementioned antenna coil is provided with a small core smaller than the aforementioned core and a joining material that magnetically joins the aforementioned small core to the aforementioned core and having a non-magnetic material component whereby the distance between the aforementioned core and the aforementioned small core can be adjusted.

Fourthly, the present invention provides a transmission antenna and an antenna coil whereby the aforementioned distance adjuster is such that the aforementioned small core is mobile in the direction of the magnetic flux generated by the aforementioned core whereon the aforementioned coil is mounted by winding.

Fifthly, the present invention provides an antenna coil outfitted with a first bobbin whereon a coil is mounted by winding, a second bobbin whereon a coil is mounted by winding and provided in the center part of the aforementioned first bobbin, and a ferrite core provided in a mobile fashion in the center of the aforementioned second bobbin.

Sixthly, the present invention provides an antenna coil having a first bobbin whereon a coil is mounted by winding, a second bobbin whereon a coil is mounted by winding and that is provided in the center of the aforementioned bobbin, and a ferrite core provided in a mobile fashion in the center of the aforementioned second bobbin, and a capacitor whereby the coil wound onto the aforementioned first bobbin and the coil wound onto the aforementioned second bobbin are connected serially, and a capacitor that is serially connected thereto and that forms a serial resonance circuit between the inductance of the aforementioned antenna coil.

Seventhly, the present invention provides a transmission antenna outfitted with a first coil, a second coil wound onto a bobbin having a ferrite core provided in a mobile fashion in the center, and a capacitor, and whereby the aforementioned first coil, the aforementioned second coil, and the aforementioned capacitor are serially connected to form a serial resonance circuit.

Optimum Form to Embody the Invention

Figure 1:
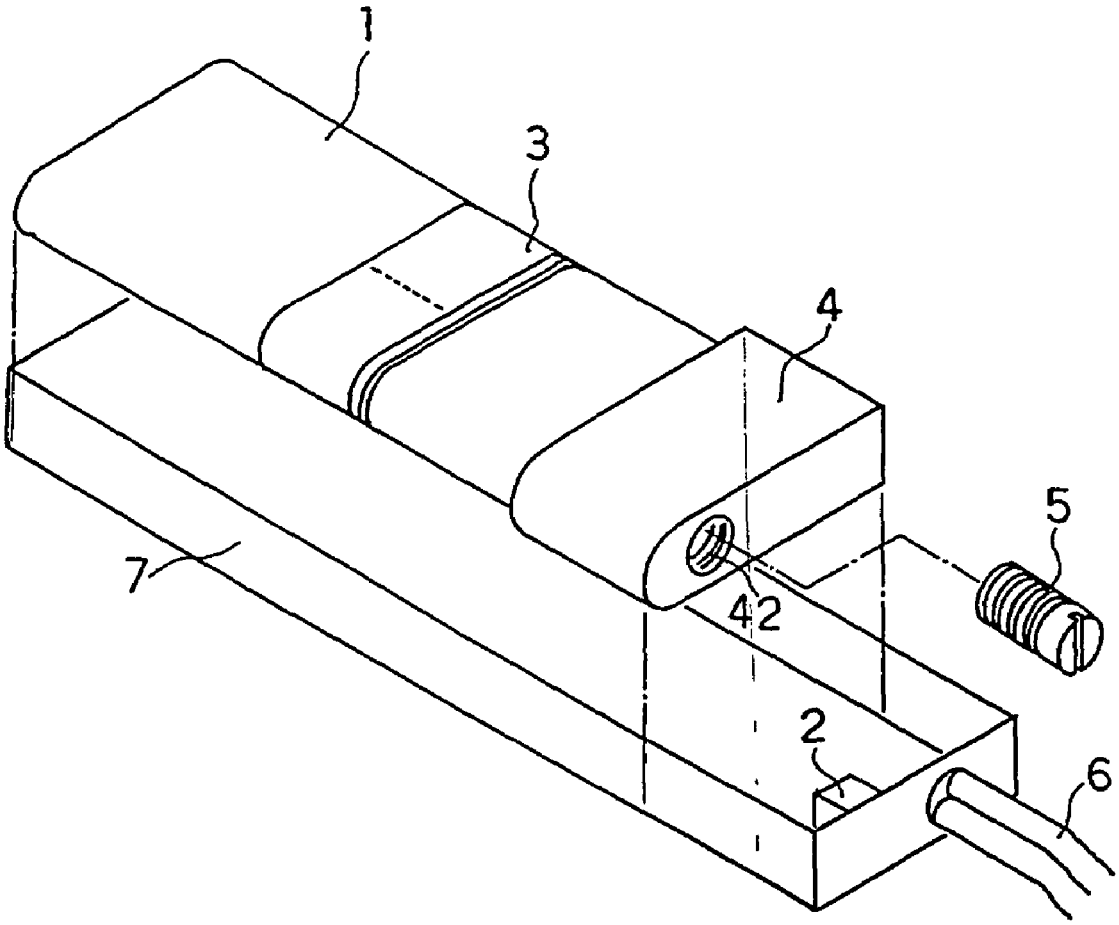
FIG. 1 is a perspective diagram depicting the transmission antenna of the present invention.
Figure 2:
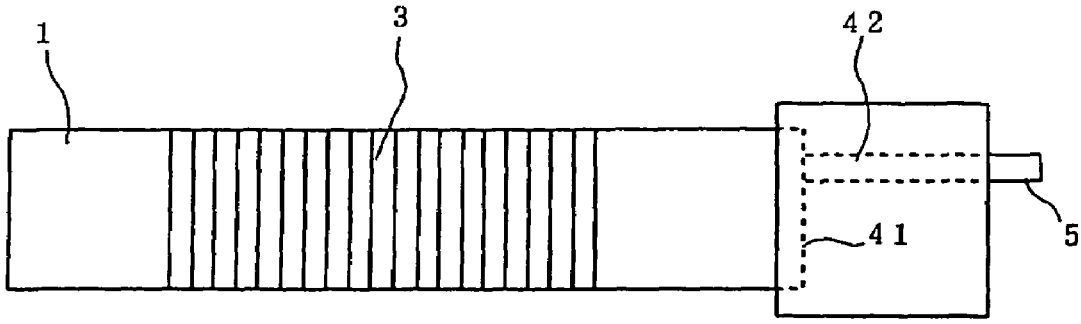
FIG. 2 is a top-down view diagram depicting the first antenna coil that is the main component of the transmission antenna of the present invention.

As depicted by the perspective diagram of FIG. 1 and the main component top-down view diagram of FIG. 2, respectively, the transmission antenna of the present embodiment is outfitted with a ferrite core (1) and a capacitor (2). An antenna coil (3) is mounted by being wound onto the ferrite core (1). The core (1) forms a flat bar and mated to one of its lengthwise ends is a small flat piece of plastic (a non-magnetic material) that serves as a distance adjuster (4). Namely, formed in one end of the distance adjuster (4) is an indented part (41) whose size corresponds to an end of core (1). One end of core (1) is inserted into, and thus mated to, this indented part.

Figure 3:
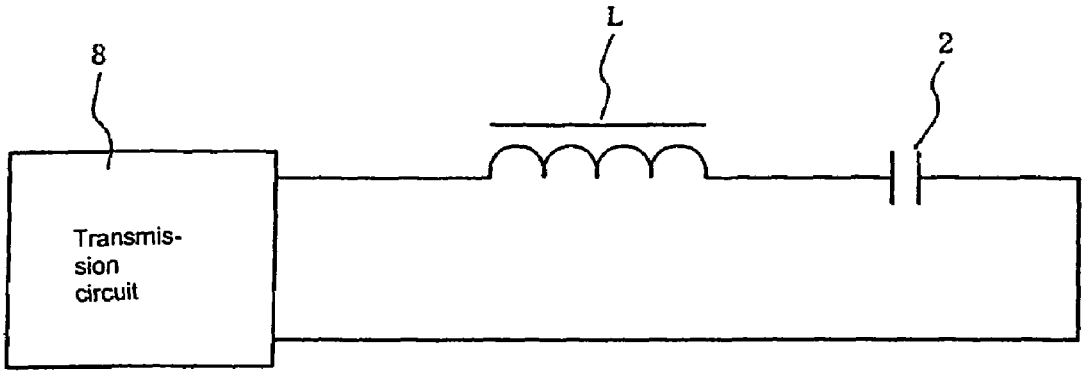
FIG. 3 is a circuit diagram of the first embodiment of the transmission antenna of the present invention.

A screw hole (42) facing the core (1) end mated to the aforementioned indented part (41) is formed in the end face of that side of the distance adjuster (4) wherein the indented part (41) is not formed. A screw (5) with a small core made of, for example, ferrite is threaded into this screw hole (42). The capacitor (2) is connected to the antenna coil (3) of antenna coil (L) outfitted with a core (1) on which the antenna coil (3) is mounted by winding. As FIG. 3 depicts, the inductance of antenna coil (L) and capacitor (2) form a serial resonance circuit.

Figure 4:
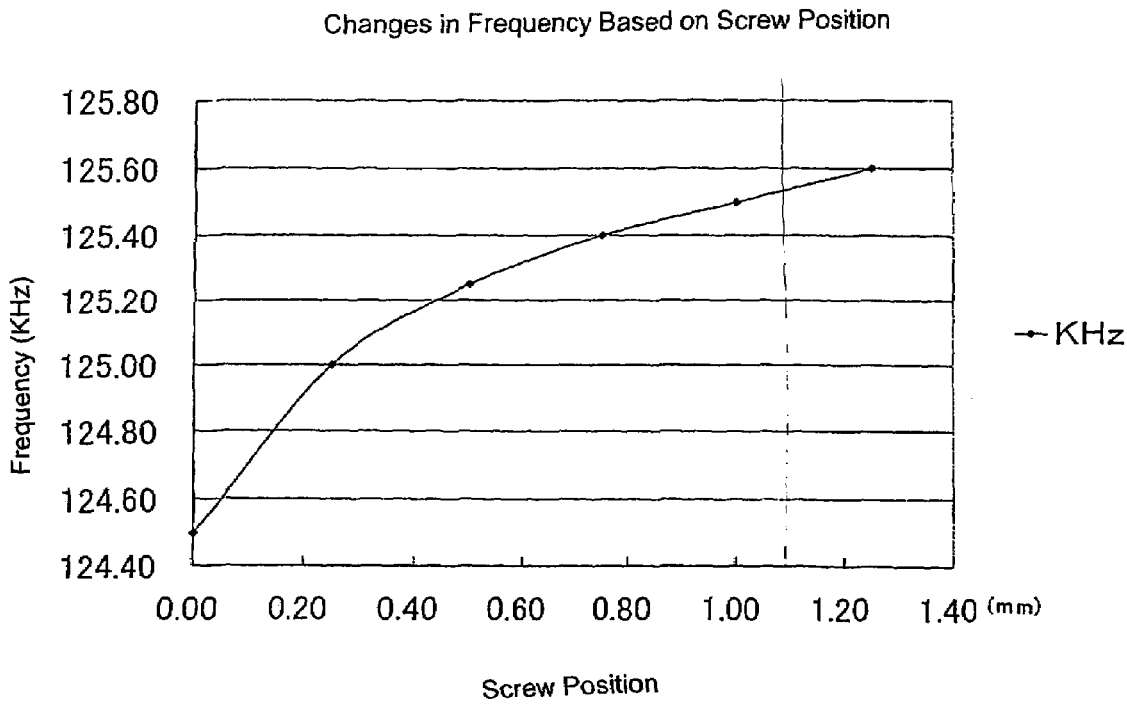
FIG. 4 is a diagram depicting the relationship between screw position and resonance circuit frequency in the transmission antenna of the present invention.

The inductance value of the antenna coil (L) can be changed by adjusting the thread volume of the screw (5). FIG. 4 depicts the relationship between the screw (5) position (distance from the core [1]) and the frequency of the resonance circuit. The resonance frequency is lowest when the screw (5) is in direct contact with the core (1). The resonance frequency can be gradually increased by diminishing the screw thread volume.

As for FIG. 4 data, the capacity of the capacitor (2) used is 3300 pF. The size of the core (1) is 50 (mm)×12 (mm)×3(mm). The screw (5) size is: Diameter 3.8 (mm) and length 3.5 (mm); the antenna coil (3) used is wound 102 times.

The transmission antenna is such that the antenna coil (L) and the capacitor (2) are connected and are further connected to an external derivation lead wire (6). This is housed in a case (7) with a lid not shown in the figures. As FIG. 3 depicts, this is connected to a transmission circuit (8) and electromagnetic waves can be transmitted.

Prior to housing in the aforementioned case (7), adjustment of the thread volume of the screw (5), setting the desired resonance frequency, and lowering the resonance circuit inductance increase the current value in the resonance circuit. By adjusting in this way, the magnetic flux emitted from the transmission antenna increases and, with the same power consumption, communication distance can be increased.

Furthermore, the perforation direction of the screw hole (42) serving as the distance adjuster is the direction of the magnetic flux generated by the core (1). Since the small core screw is mobile in the direction of the magnetic flux generated by the core (1) whereon the antenna coil (3) is mounted by winding, the direction of the magnetic flux is stable. Such generation can occur without changing the antenna directionality, even when changing the resonance frequency by adjusting the thread volume of the screw (5).

In the aforementioned embodiment, the material of the aforementioned screw (5) is ferrite. Thus, there is a relation between the thread volume of the screw (5) as depicted in FIG. 4 and the resonance frequency of the resonance circuit. However, when the screw (5) is made of copper or aluminum with a relative magnetic permeability below 1 (a negative relative magnetic permeability), the resonance frequency can be increased as the thread volume of the screw (5) is increased.

Furthermore, a structure is depicted whereby a screw (5) is thread into the screw hole (42) that serves as a distance adjuster. Also appropriate, though, is a structure whereby a hole without a screw is provided instead of a screw hole (42) and wherein is inserted a slideable tubular pin to an appropriate position and fixed by an adhesive, etc.

Figure 5:
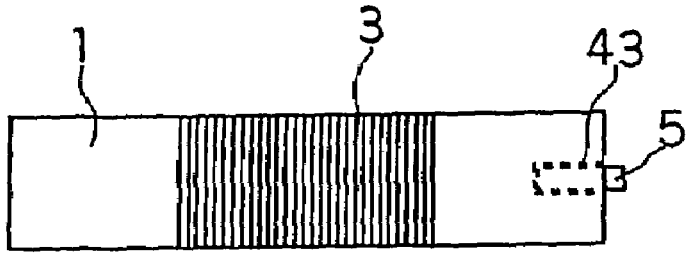
FIG. 5 is a top-down view diagram depicting a modified example of the first antenna coil that is the main component of the transmission antenna of the present invention.

FIG. 5 depicts a structural example of an antenna coil not provided with a distance adjuster (4). This antenna coil is such that a screw hole (43), which is a small hole, is formed from an end of the core (1). Threaded into this screw hole (43) is a screw (5) made of ferrite. The screw (5) is slideable and can reach an inductance value corresponding to the thread volume. The relation between the thread volume and the resonance circuit frequency is the same in an antenna coil structure in this way and that depicted in FIG. 4. Furthermore, depicted is a structure whereby the screw hole (43) is formed in the center of the end of the core (1). However, this location is not limited to the center and may be any position, provided it is in the end of the core (1).

Figure 7:
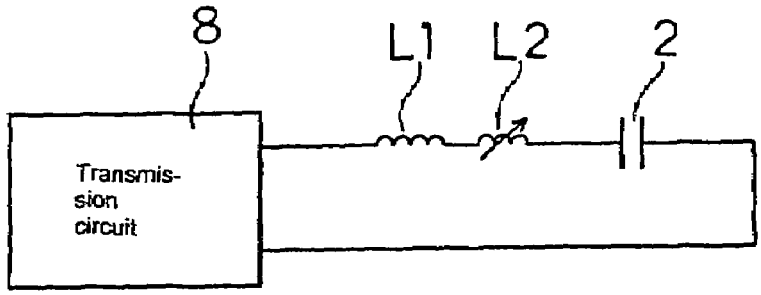
FIG. 7 is a circuit diagram of the second embodiment of the transmission antenna of the present invention.

In the preceding invention, the transmission antenna has the circuit structure that depicted in FIG. 3. As FIG. 7 depicts, a first coil whereby the inductance value is set and a second coil whereby the inductance value is variable can be used. The first coil (L1), the second coil (L2), and the capacitor (2) are connected serially to form a serial resonance circuit. This is connected to a transmission circuit such that electromagnetic waves can be emitted.

Figure 8:
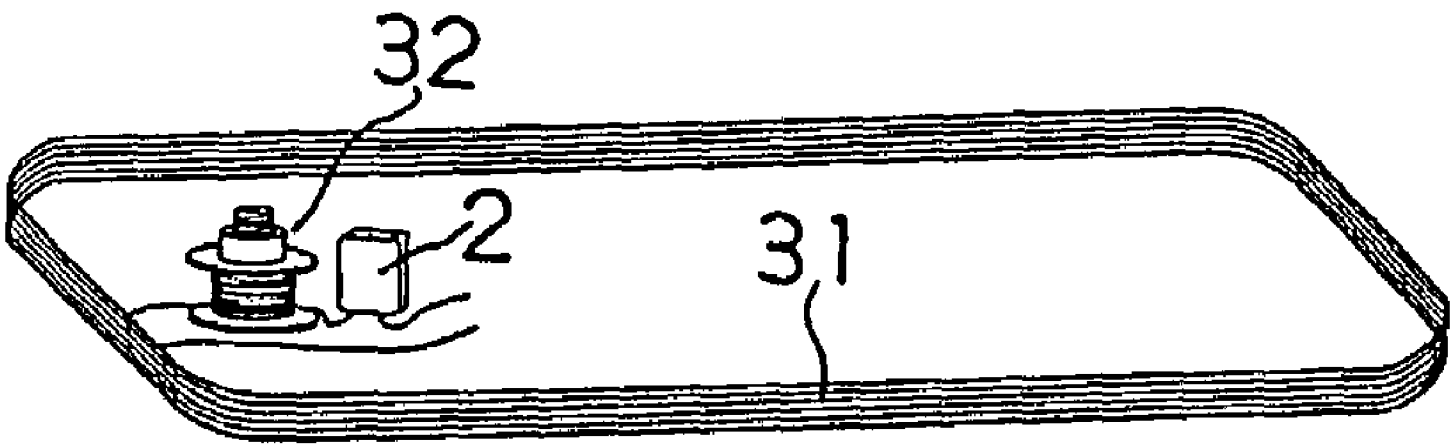
FIG. 8 is a perspective diagram depicting the structure of a resonance circuit wherein the second embodiment of the transmission antenna of the present invention is realized using the antenna coil depicted in FIG. 6.
Figure 11:
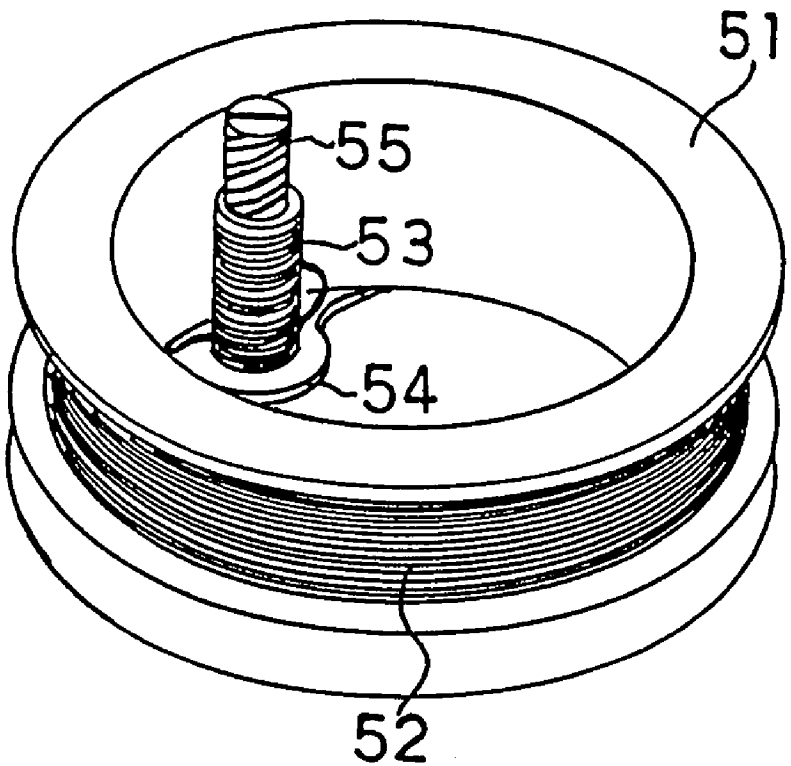
FIG. 11 is a perspective diagram depicting the structure of a resonance circuit when the second embodiment of the transmission antenna of the present invention is realized using a bobbin as an antenna coil.
Figure 12:
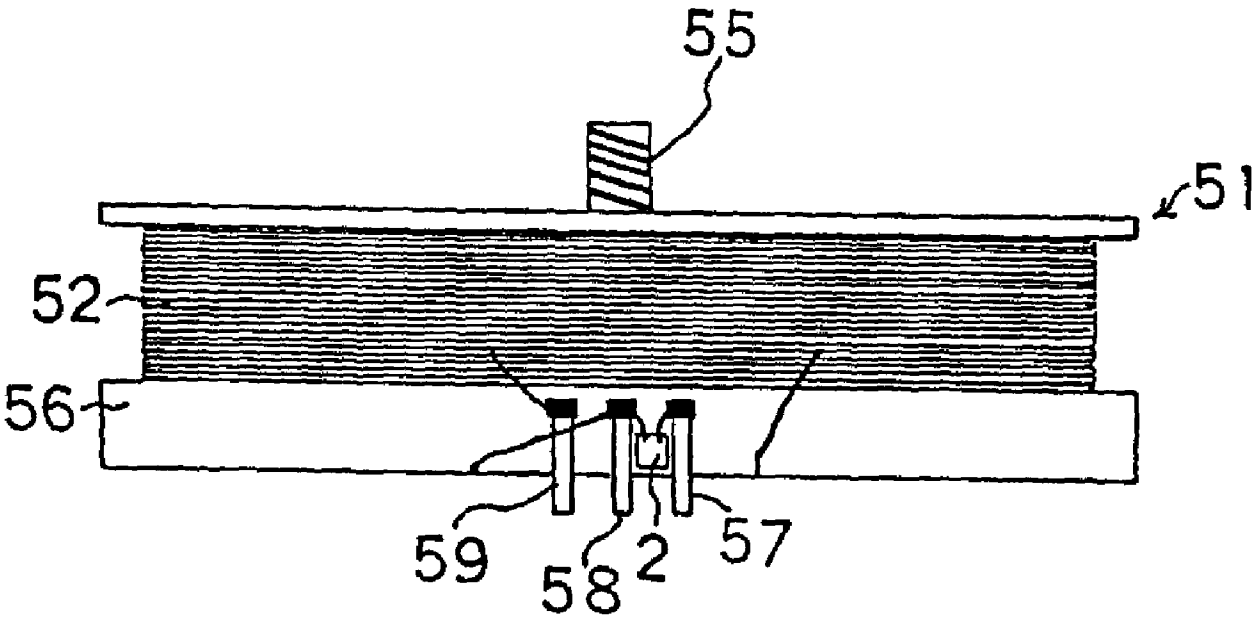
FIG. 12 is a full-frontal diagram depicting the structure of a resonance circuit when the second embodiment of the transmission antenna of the present invention is realized using a bobbin as an antenna coil.

The second coil (L2) that FIG. 7 depicts corresponds to the small L-value adjustment coil comprised of the second coil (32) FIG. 8 depicts and to the coil (53), bobbin (54), and screw (55) that FIG. 11 and FIG. 12 depict. The first coil (L1) in FIG. 7 corresponds to the first coil (31) FIG. 8 depicts and the coil (52) FIG. 11 depicts. In FIG. 7, the structure is such that the small L-value adjustment coil (L2) is connected to the antenna coil (L1) which becomes the main coil. The examples in FIG. 2 and FIG. 5, by contrast, themselves constitute the L-value adjustment antenna coil.

Figure 6:
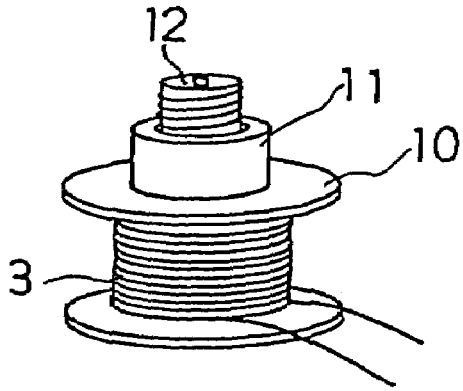
FIG. 6 is a perspective diagram depicting the second antenna coil that is the main component of the second embodiment of the transmission antenna of the present invention.
Figure 9:
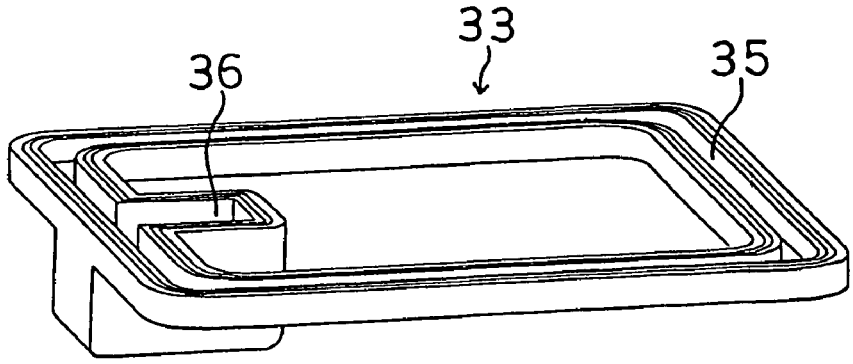
FIG. 9 is a perspective view depicting a case to house the resonance circuit of FIG. 8.
Figure 10:
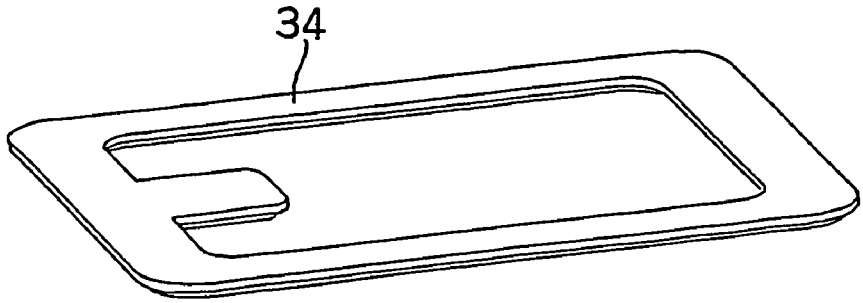
FIG. 10 is a top-down view diagram depicting the lid of the case of FIG. 9.

FIG. 8 depicts a structural example of a serial resonance circuit using the coil depicted in FIG. 6. Serially connected are a first coil (31) coiled about a hollow core in a generally square-shaped loop, a second coil (32) depicted in FIG. 6, and a capacitor (2). Such a serial resonance circuit is housed in a case (33) depicted in FIG. 9 and covered with a lid (34) depicted in FIG. 10.

The case (33) is formed in the shape of a generally square loop and is provided with a groove (35) to house the aforementioned first coil (31) and, on one side of groove (35), with a rectangular parallelepiped chamber (36). Drawn out from the chamber (36) to the outside are, respectively, a lead wire extending from one end of capacitor (2) and a lead wire extending from the first coil and connected to the transmission circuit (8). In a serial resonance circuit so structured, the second coil (32) is the antenna coil that FIG. 6 depicts and the thread volume of the screw (12) is appropriately adjusted to the desired property.

FIG. 11 and FIG. 12 depict structural examples of a serial resonance circuit relating to a different structure used in a transmission antenna. Coil (52) is coiled onto the first bobbin (51). In the center (hollow part) of the first bobbin, the second bobbin (54) on which coil (53) is mounted by winding is provided integrally to the first bobbin (51). In the center of the second bobbin (54) is provided a screw (55), which is a mobile ferrite core. The coil structure comprising this second bobbin (54) and the screw (55) is basically equivalent to the antenna coil structure that FIG. 6 depicts.

Provided in the supporting brim (56) on one side of the first bobbin (51) are terminals (57), (58), and (59). Between terminal (57) and (58) are connected a capacitor (2) while one end of the coil (52) is connected to terminal (59). A serial resonance circuit is formed by connections whereby the coil of the first bobbin (51) and coil (52) correspond to coil (L1) in FIG. 7, while the coil of the second bobbin (54) and coil (53) correspond to coil (L2) in FIG. 7. Terminal (57) and terminal (59) are connected to transmission circuit (8) to form a transmission antenna. In this transmission antenna too, the resonance frequency of the serial resonance circuit is set to the desired value by appropriately adjusting the thread volume of the screw (55).

USABILITY IN INDUSTRY

In the present invention as described above, to a core whereon a coil is mounted by winding is magnetically joined a small core smaller in size than the former and the distance between the aforementioned core and the aforementioned small core is adjusted. Possibly, a screw made of ferrite, etc. whose inductance value is adjustable is provided and the screw volume of this screw is adjusted. The resonance frequency of the serial resonance circuit is set as desired by this adjustment, the inductance of the resonance frequency in the transmission antenna decreases, the current value in the resonance circuit increases, the magnetic flux radiated from the transmission antenna increases and, with the same power consumption, the communication distance can be extended, which is extremely beneficial.

The invention claimed is:

1. An antenna coil, comprising:

a first core whereon a coil is mounted by winding;

a second core smaller than the first core; and a joining material that magnetically joins the second core to the first core and has a non-magnetic distance adjuster to adjust a distance between the first core and the second core.

2. The antenna coil of claim 1, wherein the second core includes a screw, and a screw hole is formed in the distance adjuster.

3. The antenna coil of claim 1 or claim 2, wherein the distance adjuster is mobile in a direction in which a magnetic flux is generated from the first core comprising the coil mounted by winding.

4. The antenna coil of claim 1, wherein the first core and the second core are both made of ferrite.

5. An antenna coil, comprising:

a first bobbin whereon a first coil is mounted by winding;

a second bobbin whereon a second coil is mounted by winding, the second bobbin provided in a center of the first bobbin; and a ferrite core provided in a mobile fashion in a center of the second bobbin.

6. The antenna coil of claim 5, wherein the ferrite core comprises a screw, and a screw hole is formed in the center of the second bobbin.

7. A transmission antenna, comprising:

an antenna coil including a first core onto which a coil is mounted by winding; and a capacitor connected to the coil, the capacitor and an inductance of the antenna coil forming a serial resonance circuit;

wherein the antenna coil further includes a second core smaller in size than the first core, a joining material that magnetically joins the second core to the first core, and a non-magnetic material distance adjuster to adjust a distance between the first core and the second core.

8. The transmission antenna of claim 7, wherein the distance adjuster is such that the second core is mobile in a direction of a magnetic flux generated by the first core whereon the coil is mounted by winding.

9. A transmission antenna, comprising:

an antenna coil including a first bobbin whereon a first coil is mounted by winding;

a second bobbin provided in a center of the first bobbin, and a second coil mounted on the second bobbin by winding; and a ferrite core provided in a mobile manner in a center of the second bobbin; and a capacitor;

wherein the first coil wound onto the first bobbin, the second coil wound onto the second bobbin, and the capacitor are connected serially to form a serial resonance circuit.

10. A transmission antenna, comprising:

an antenna coil perforated with a small hole, the antenna coil including a first core whereon a coil is mounted by winding; and a second core provided in the small hole, the second core being provided in a mobile manner;

a capacitor connected to the coil, the capacitor and an inductance of the coil mounted by winding forming a serial resonance circuit; and a distance adjuster to adjust a distance between the first core and the second core;

wherein the distance adjuster is such that the second core is mobile in a direction of a magnetic flux generated by the first core.

* * * * *